US006752731B1

(12) United States Patent
Kramer

(10) Patent No.: US 6,752,731 B1
(45) Date of Patent: Jun. 22, 2004

(54) COMBINATION BAT KNOB AND HANDLE GRIP

(76) Inventor: Robert M. T. Kramer, 3032 E. Commercial Blvd., Fort Lauderdale, FL (US) 33308

( * ) Notice: Subject to any disclaimer, the term of this patent is extended or adjusted under 35 U.S.C. 154(b) by 0 days.

(21) Appl. No.: 09/659,770

(22) Filed: Sep. 11, 2000

Related U.S. Application Data

(63) Continuation-in-part of application No. 09/179,600, filed on Oct. 27, 1998, now abandoned, which is a continuation-in-part of application No. 08/581,455, filed on Dec. 29, 1995, now Pat. No. 5,839,983, which is a continuation-in-part of application No. 08/187,308, filed on Jan. 25, 1994, now abandoned, which is a continuation-in-part of application No. 08/089,712, filed on Jul. 9, 1993, now abandoned.

(51) Int. Cl.[7] ..... A63B 59/06
(52) U.S. Cl. ..... 473/568; 473/457
(58) Field of Search ..... 473/564–568, 473/457, 514, 520

(56) References Cited

U.S. PATENT DOCUMENTS 2,101,714 A * 12/1937 Keeney ..... 473/568
4,134,198 A * 1/1979 Briggs ..... 473/568
5,005,254 A * 4/1991 Uffindell ..... 473/568
5,482,270 A * 1/1996 Smith ..... 473/568
5,571,050 A * 11/1996 Huang ..... 473/568
5,577,722 A * 11/1996 Glassberg ..... 473/568
5,611,533 A * 3/1997 Williams ..... 473/568
5,839,983 A * 11/1998 Kramer ..... 473/568

* cited by examiner

*Primary Examiner*—Mark S. Graham
(74) *Attorney, Agent, or Firm*—Malin, Haley & DiMaggio, P.A.

(57) ABSTRACT

A one body member (combination bat handle and knob ball bat grip) for improving the gripping action of a batter for baseball or softball, which is useful for left handed or right handed players. The longitudinal raised surface along the bat handle and knob allows the batter alignment of the knuckles for proper wrist roll. The grip is sized to fit around the bat handle and bat knob allowing the batter for gripping the handle with the top hand and gripping the bat knob with the lower hand. The grip fits moveably snug around the bat handle and knob for manually rotating around the bat handle and knob to prolong the lift of thin walled aluminum bats. Also can keep the label lined up when batting with wood bats. The grip is essentially immovable when manually squeezed by the batter. Finger channels or finger separating barriers may be included along the longitudinal raised surface. The grip is made of thermoplastic rubber or the likes that helps to reduce vibration, sting and blistering to the hands of the batter.

5 Claims, 3 Drawing Sheets

FIG. 5A
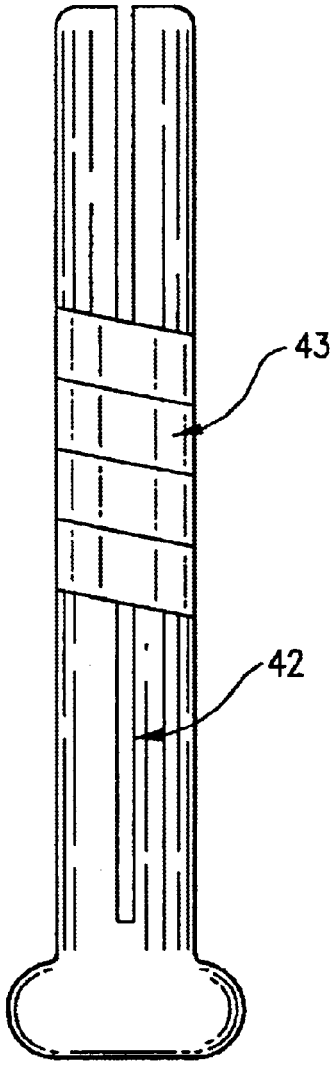
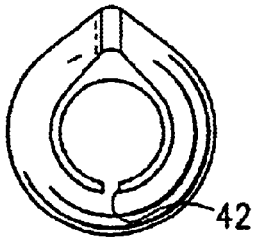
FIG. 5B

COMBINATION BAT KNOB AND HANDLE GRIP

This application is a continuation-in-part of U.S. application Ser. No. 09/179,600 filed Oct. 27, 1998. abandoned which was a continuation-in-part of Ser. No. 08/581,455, filed Dec. 29, 1995 Pat. No. 5,839,983 which is a continuation-in-part of U.S. patent application Ser. No. 08/187,308 filed Jan. 25, 1994, abandoned which is a continuation-in-part of application Ser. No. 08/089,712 filed Jul. 9, 1993.

BACKGROUND OF THE INVENTION

1. Field of the Invention

This invention relates to hand grips for ball bats, for use with a baseball bat or a softball bat, used for playing hardball or softball. The invention is a single elongated combination bat knob and handle grip sized to receive both hands simultaneously to provide tactile sensations for knuckle alignment for each hand. The grip can be adjusted on the bat relative to the individual's preference.

2. Description of the prior art

The game of baseball at all levels is typically played with either a wooden or an aluminum bat, and is used to strike the baseball. Similarly, the game of softball also uses either a wooden or aluminum bat. Although major baseball leagues still only use wooden bats, many college leagues and little league organizations employ the aluminum bat. Heretofore, players have often worn gloves to increase their gripping power when gripping the typical part of the bat that is used when striking the ball. Often the wood or metal surface of the bat can be slippery, especially if the hands are sweaty, and players use an additional sticky substance such as pine tar in conjunction with gloves to achieve a better grip on the bat. Because of their slick metal surface, aluminum softball bats come with adhesively attached tape that provides some form of grip. One of the great drawbacks of this type of tape grip is that the tape quickly becomes worn and is then no longer suitable as a gripping surface. Using tar with batting gloves is often an unpleasant experience because of the sticky substance attaches to other parts of a player's clothing and has a very distinctive unpleasant odor.

The present invention overcomes the problems of the prior art by providing for a substantial bat knob and handle grip that allows for use of both hands and either a left handed or right handed player. The grip includes a raised surface portions for better holding power and is designated for proper knuckle alignment. The grip is made from Thermoplastic Rubber or the likes and sized to fit snugly around the knob and handle of the bat, regardless of whether it is wood or aluminum while permitting adjustable placement to the batters liking. Using the present invention, the batter can grip the lower portion of the bat knob as well as the upper portion of the bat handle. This arrangement allows the hands and especially the knuckles to adjust to the proper position.

In an alternative embodiment of the invention, the grip is made from Thermoplastic Rubber or the likes and of a single elongated member that is sized to fit snugly but movably around the lower knob portion of the bat, as well as the upper portion of the bat handle with the grip length being sized to receive both hands simultaneously. The single elongated grip includes a dome or raised exterior surface that gives tactile information to the hands to tell where the knuckles are relative to the grip for proper knuckle alignment, with a combination of the dome or raised exterior surface and finger channels or finger separating barriers are added to the dome or raised exterior surface for added gripping power.

The single elongated combination bat knob and handle grip for both hands simultaneously may also include an elongated longitudinal slot (or slit) that starts approximately ½ inch from the bottom of knob end and runs up through to the top which allows the grip body member to be resiliently spread apart to permit attachment to an existing bat and which may also include adhesive tape for wrapping all or portions of the single grip to hold the slit together flush once the grip has been positioned on the bat. The grip may also be installed at the factory and/or as an after-market product by sliding it over the end of the bat knob or, with a slotted embodiment, attached to an existing bat and securing with a continuous spiral of tape.

SUMMARY OF THE INVENTION

A grip for use with a ball bat such as a hardball or softball bat used to play the game of baseball and softball. The grip is comprised of a one body member, having tubular channels disposed therethrough and closed at the bottom or can be opended at both ends and sized in diameter to fit snugly but movably around the outside surface of the bat knob and bat handle of a conventional ball bat. The body member is composed of a material such as Thermoplastic Rubber or the likes that creates good frictional contact between the epidermis of a player's hands, and the outer surface of the bat knob and handle grip.

The elongated combination bat knob and handle grip shall have a dome or protruding surface that includes a raised straight elongated segment along one portion of the grip which allows the user to tactilely feel the circumferential surface difference to identify the location of the hands relative to the grip. The raised portion can be felt by each hand simultaneously so that the user can appreciate proper knuckle alignment. The elongated raised portion is unitarily formed with the entire grip and is comprised of the same material in a uniform manner. The opposite portion from the elongated raised portion has an ultra-thin wall thickness which is approximately 0.030 inches.

The elongated combination bat knob and handle grip can also include a plurality of finger channels, or finger separating barriers, at least eight, in a side by side array along one side of the device so that the hands can have a fit on the grip with the fingers being properly aligned around the outside circumference portion of the grip. The fingers will rest in channels or between finger separating barriers that are sized to receive fingers of the user. The one body elongated bat grip for two hands has simultaneously the raised extended portion that is elongated from one end to the other along with finger channels or finger separating barriers as described herein.

The elongated grip for use with two hands as a single member will also include in one embodiment a slit along the side opposite the raised segment which will allow the grip to be attached to an existing bat along with an adhesive tape to wrap around portions of the grip. The tape could be resilient vinyl with adhesive on one side.

For the molded singular integral embodiment, the elongated grip could be placed on the bat at the factory.

To operate the invention, the one body elongated grip once the grip has been installed on a bat, the user can feel the raised segment and rotate the entire grip relative to the bat so that the batter can locate the desired spot when the bat is being held. The user can also feel the raised surface portion of the rip and adjust the hands for proper knuckle alignment.

It is therefore a principal object of this invention to provide an improved baseball or softball bat grip.

It is yet still another object of this invention is to provide for an improved hand grip for a bat that can reduce vibration, stinging, or blistering of the hands while improving the grip on the bat.

But yet still another object of the invention is to provide a hand grip that can be installed on existing bats or permanently installed at the factory when the bat is manufactured.

In accordance with these and other objects which will be apparent hereinafter, the instant invention will now become described with particular reference to the accompanying drawings.

BRIEF DESCRIPTION OF THE DRAWINGS

FIG. 5A shows a back elevational view of the alternate embodiment of the invention.

FIG. 5B shows a top plan view of the alternate embodiment shown in FIG. 5A element 42.

DESCRIPTION OF THE PREFERRED EMBODIMENTS

Figure 1:
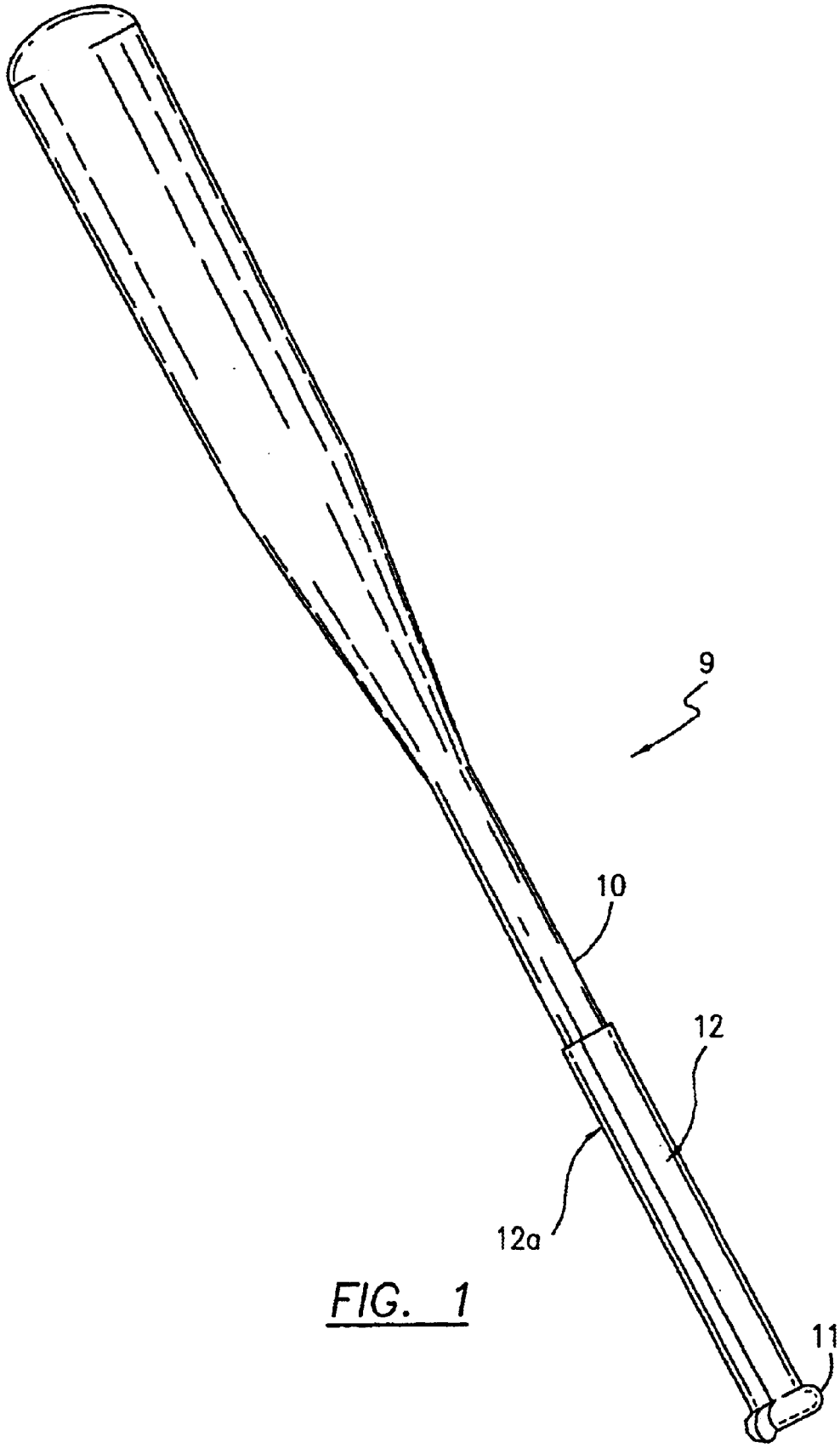
FIG. 1 shows a side elevational view of the present invention installed on a baseball bat.

Referring now to the drawings, and in particular FIG. 1, the present invention is shown generally at 9, comprised of a combination handle and knob grip 12 as a one body member snugly attached around the portion of a baseball bat handle 10 and knob 11 that covers the knob of bat. The bat itself may be made of wood or aluminum and be used for baseball or softball.

Figure 4A:
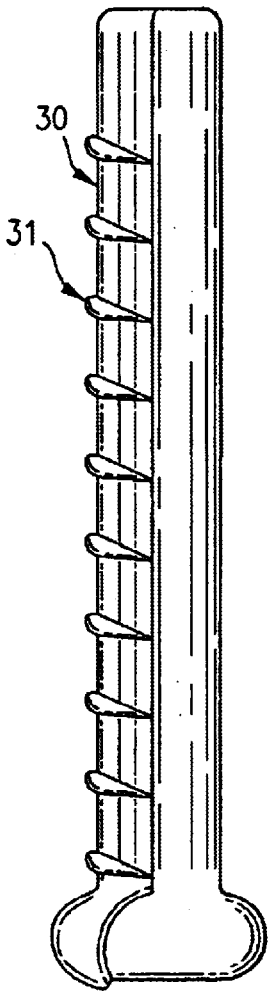
FIG. 4A shows a side elevational view of yet another alternate embodiment of the invention.
Figure 2B:
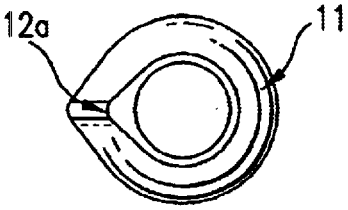
FIG. 2B shows a top plan view of the embodiment shown in FIG. 2A.
Figure 3B:
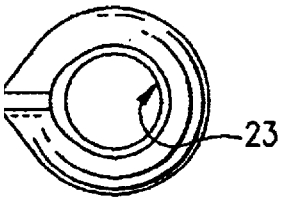
FIG. 3B shows a top plan view of the alternate embodiment shown in FIG. 3A.
Figure 4B:
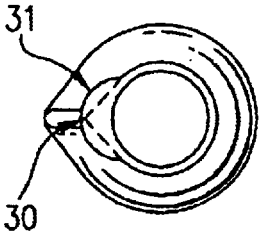
FIG. 4B shows a top plan view of the alternate embodiment shown in FIG. 4A.

The hand grip 12 is a single, unitary elongated tube that is opened at the top and closed at the bottom end after the knob and having a raised portion that is disposed longitudinally 12*a* to provide for knuckle alignment. The embodiment shown in FIG. 1 is made of a resilient Thermoplastic Rubber or the likes material that can stretch but fit snugly with the diameter size around the bat handle and knob. The batter can move the hand grip circumferentially around the bat until a desired location is found which provides for aligning the sweet spot or the best impact spot on the bat relative to the grip during the swing. Although this may be somewhat subjective by the batter, it allows the batter to select the impact position of the bat relative to the ball during a swing based on the batter's preference. Once the grip has been rotated to the position around the bat surface desirable by the batter, then the grip would stay in that position because it is made of a material such as thermoplastic rubber or the likes having a durometer value of 15 to 60 that has enhanced friction so that when it is squeezed the grip will firmly hold the bat in place and will not rotate around the bat handle in a squeezed position. The knob cover 11 covers the end of the bat knob for comfort for people who like to hold the bat knob end. FIGS. 4A and 4B show the embodiment that include separating barriers 31 for the fingers for both hands simultaneously while at the same time having a raised ridge 30 that provides for knuckle alignment while the fingers are separated by separating barriers 31. The thickness of the raised ridge can be 0.250 inches at the highest point. The remaining body thickness can be 0.030 inches.

Figure 3A:
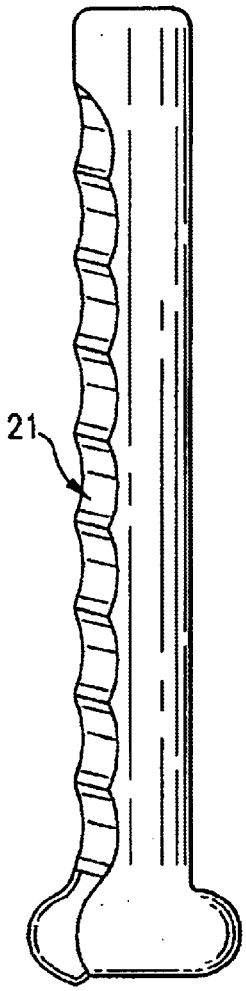
FIG. 3A shows a side elevational view of an alternate embodiment of the invention.

FIG. 3A shows an alternate embodiment of the grip to include finger receiving channels 21, with the remainder of the structure being similar. Again, the grip is resilient enough in the inside diameter 23 so that it can be manually positioned round the bat until the batter finds a desired location.

Figure 2A:
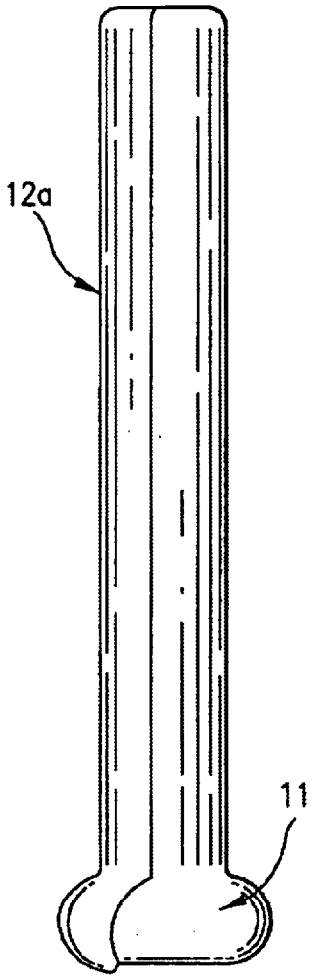
FIG. 2A shows the side elevational view shown in FIG. 1 without the baseball bat.

FIG. 2A shows another embodiment of the invention that does not have the finger separators but includes the raised ridge or dome style portion 12A for knuckle alignment in conjunction with the resilient one body member for two hands that includes the knob cover 11.

FIG. 5A shows another embodiment of the invention that may also include either the finger receiving channels grip or the finger separating barriers grip or the dome style grip as defined in FIG. 5A. On the back side of the grip is a narrow slot 42 that starts approximately ½ inch from the bottom of knob end and runs up through to the top. This allows the grip to be spread apart and placed around the handle a and knob of the bat. Also in FIG. 5A, tap 43 is then wrapped around the grip from top to bottom to firmly old it snuggly against the handle and knob of the bat.

FIG. 5B shows the top plan view of FIG. 5A.

The instant invention has been shown and described herein in what is considered to be the most practical and preferred embodiment. It is recognized, however, that departures may be made therefrom within the scope of the invention and that obvious modifications will occur to a person skilled in the art.

What I claimed is:

1. A one body member combination bat knob and bat handle grip including a single continuous longitudinal, raised exterior surface portion for knuckle alignment and for proper wrist roll and for increasing the gripping control, sized in length for being grasped by two hands simultaneously by a batter, and having a lower portion sized in proportion to fit around a bat knob and knob coverage so that batter can engage the lower gripping hand around the knob of grip, said body member having an inside cylindrical passage sized to fit movably snug around a bat knob and bat handle and said inside cylindrical passage being open at the bottom end when engaged around the bat knob and open at the top end when engaged around the bat handle; and said body member being essentially immovable when manually squeezed, said body member is manufactured from a resilient thermoplastic material with a hardness that can be from 15 shore A to 60 shore A for reducing vibration, sting and blistering on the hands of the batter.

2. A ball bat grip as in claim 1, wherein the body member has a longitudinal split, said longitudinal split for spreading said body member apart and placing said member around the bat knob and the bat handle.

3. A bat grip as in claim 2, including: tape means wrapped around the exterior of said body member.

4. A bat grip in claim 1, wherein the body member raised surface portion include a plurality of finger receiving channels disposed about the body member.

5. A bat grip as in claim 1, wherein said body member raised surface portion includes a plurality of finger separating barriers spaced apart sufficiently to allow individual fingers to be received between adjacent finger separating barriers.

* * * * *